US009581154B2

(12) United States Patent
Wang et al.

(10) Patent No.: US 9,581,154 B2
(45) Date of Patent: Feb. 28, 2017

(54) PISTON WITH A HEAT EXCHANGER

(71) Applicant: TSC MANUFACTURING AND SUPPLY, LLC., Houston, TX (US)

(72) Inventors: Jianke Wang, Conroe, TX (US); Mengzhen Zhang, Katy, TX (US); Edwin C. Lewis, II, Katy, TX (US)

( * ) Notice: Subject to any disclaimer, the term of this patent is extended or adjusted under 35 U.S.C. 154(b) by 294 days.

(21) Appl. No.: 14/316,076

(22) Filed: Jun. 26, 2014

(65) Prior Publication Data

US 2015/0377232 A1 Dec. 31, 2015

(51) Int. Cl.
*F04B 53/14* (2006.01)
*F04B 53/08* (2006.01)

(52) U.S. Cl.
CPC ..... *F04B 53/14* (2013.01); *F04B 53/08* (2013.01); *F04B 53/148* (2013.01)

(58) Field of Classification Search
CPC ..... F04B 53/08; F16J 1/08
USPC ..... 92/145, 157, 160, 159, 144, 182
See application file for complete search history.

(56) References Cited

U.S. PATENT DOCUMENTS 3,720,140 A * 3/1973 Lee ..... F04B 53/164 277/434
4,023,469 A * 5/1977 Miller ..... F04B 53/143 92/112
4,157,057 A 6/1979 Bailey
4,270,440 A * 6/1981 Lewis, II ..... F04B 53/143 92/182
8,312,805 B1 * 11/2012 Blume ..... F04B 53/143 277/560
2008/0257143 A1 * 10/2008 Leman ..... F04B 15/02 92/5 R

FOREIGN PATENT DOCUMENTS

WO WO2009051493 A2 9/2009

* cited by examiner

*Primary Examiner* — Thomas E Lazo
(74) *Attorney, Agent, or Firm* — Lai, Corsini & Lapus, LLC; Theodore Lapus

(57) ABSTRACT

A piston with an integrated heat exchanger comprises a seal, a piston hub and a piston rod. The piston hub is further provided with a coolant reservoir and an outlet nozzle at its lateral surface. The heat exchanger integrated into the piston hub and/or the piston hub include a coolant manifold, a coolant passage communicating thereto, and a plurality of channels connecting to the coolant manifold and extending radially to the annulus. Said heat exchanger provides enhanced efficiencies of heat-exchange and debris-flushing.

19 Claims, 5 Drawing Sheets

PISTON WITH A HEAT EXCHANGER

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND

Pump pistons for use in mud or slush pumps are virtually expendable. Their lives are relatively short compared with their mating components such as liners or cylinders. Typically, a liner often runs twice or even longer than its mating piston.

The pistons moving back-and-forth within the liners or the cylinders will suffer damages mainly from two sources. The first one would be heat generated during the movements. Generally, the heat degrades piston's seal or ring, which usually is made of elastic materials such as rubber or polyurethane, has a greater diameter than the inner diameter of the cylinder or the liner so that leakage could be prevented. Thus, during the movements, the piston is consistently scrubbing said wall, from which the heat is generated.

The second source is scratching to the piston by debris. The debris may be foreign materials leaked from the liner or the cylinder, or detached materials from the wall of the liner/cylinder, or the piston. The scratching is especially damageable to the seal or the ring, since they are typically made of relevant soft materials comparing to the wall and other portions of the piston.

In order to reduce the damages to the pistons, they are equipped with flushing systems, wherein liquids are pumped into the pistons and carrying away both the heat and the debris.

For example, WO 2009/051493 discloses a piston head have a fluid supply mean 52 passing through the piston head to an annulus between a first and a second projection of said head. Especially, both projections are designed with angles so that water or oil may be forced into the annulus, flush away the heat and the debris, and substantially flow into the cylinder's working space.

For another example, U.S. Pat. No. 3,720,140 discloses a piston that has a fluid supply carried through flexible conduit which is threadedly secured into a piston rod, communicating with passageways. The passageways in term communicate with an annular groove in the periphery of a flange of the piston. Similar to that disclosed in WO 2009/051493 the liquid carrying the heat and the debris flows into the cylinder's working space.

To further protect the pistons from damages caused by the heat and the debris, there is a need for a more efficient system to exchange the heat and flush away the debris. There is also a need for a system that provides more uniformly distributed exchanging and flushing effects.

BRIEF DESCRIPTION OF THE INVENTION

The present invention relates to a piston having a heat exchanger. More specifically, said heat exchanger allows coolants to be forced into the exchanger from a pressure source, and take away heat and debris generated during working. Even more specifically, said heat exchanger allows the coolant to be evenly distributed within the piston and around the peripheral thereof, therefore an enhanced efficiency of heat-exchange and debris-flushing may be achieved.

According to one embodiment of the present invention, the piston comprises a piston rod and a piston top. The piston rod is further provided with a threaded head that may be threaded into a recess provided to the piston top.

The piston top consists of a seal and a piston hub, wherein the piston hub includes a hex head portion and a flange portion. The flange portion is further provided with a lateral surface, a front surface and a rear surface with the recess. The lateral surface is provided with a first projection, a second projection, and an annulus.

The two projections both have their distances away from a wall of a liner or a cylinder. Preferably, the second projection and the wall define an outlet nozzle having an angle $\alpha$, wherein coolants carrying heat and debris will be squirt out therefrom.

Preferably, the hex head portion is shaped into a hexahedron.

Preferably, the seal consists of a soft segment made of relatively soft materials and a hard segment made of relatively hard materials. The seal is mounted and secured to the piston hub. Preferably, the seal is boned thereto. More preferably, a plurality of coupling grooves, coupling projections, as well as their counterparts, is respectively provided to the piston hub and the seal to facilitate the bonding. Even more preferably, the seal is detachable from the piston hub.

According to yet another embodiment, the seal has a passing-though hole to its center fitting the shape and diameter of the hex head portion.

According, a passage connecting to an inlet is provided to the piston; and, a centralized manifold communicating to the passage is provided to the piston hub. Said manifold has a maximum diameter greater than that of the passage.

According, the centralized manifold is provided with a plurality of holes on one or multiple planes perpendicular to the longitudinal axis of the piston hub. Each of the holes is connected to a channel. The channels radially extend through the piston hub and connect to the annulus, also known as a coolant reservoir.

An object of the present invention is to provide a more efficient and more uniformed system for heat exchange to a piston.

Yet another object of the present invention is to provide a more efficient and more unformed system for debris flushing to a piston.

DESCRIPTION TO THE DRAWINGS

The drawings described herein are for illustrating purposes only of selected embodiments and not all possible implementation and are not intended to limit the scope of the present disclosure.

DETAILED DESCRIPTION OF THE INVENTION

The present invention will now be described more fully hereafter with reference to preferred embodiments and corresponding drawings. However, it may be embodied in many different forms and the described embodiments could not be construed as limits to the scope of it. Likewise, the terms introduced in this application do not service as restrictions to the intended components, structures and/or functions thereof. Rather, this description is provided as that this application will be thorough and complete, and will fully convey the true scope of the invention to those skilled in the art.

Therefore, the description herein shall be considered as illustrative only of the principles of the invention. All suitable modifications and equivalents may be resorted to, fall within the scope of the invention.

The present invention relates to a piston with an integrated heat exchanger, wherein the piston is designed for reciprocation within a cylinder or liner.

Figure 1:
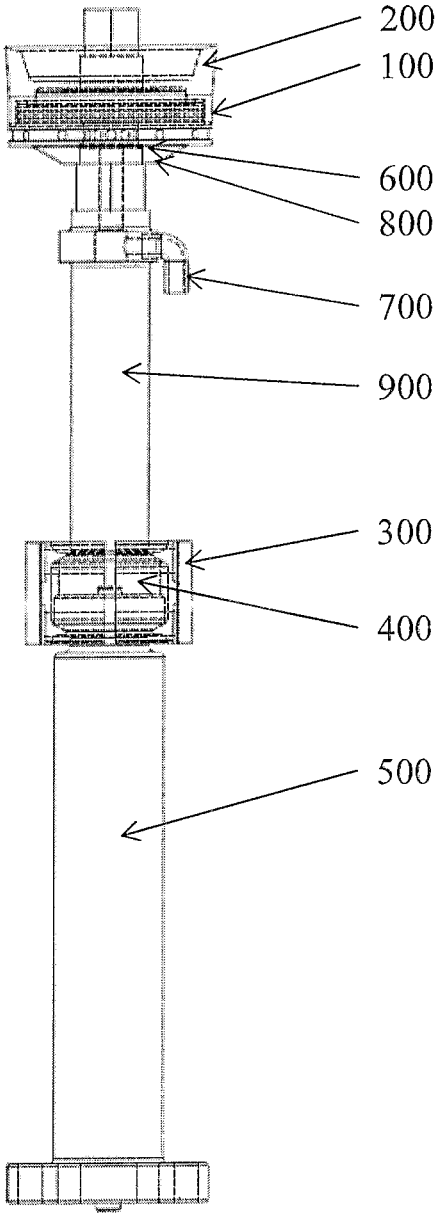
FIG. 1 is a side cross-sectional view of one embodiment of the present invention.
Figure 2:
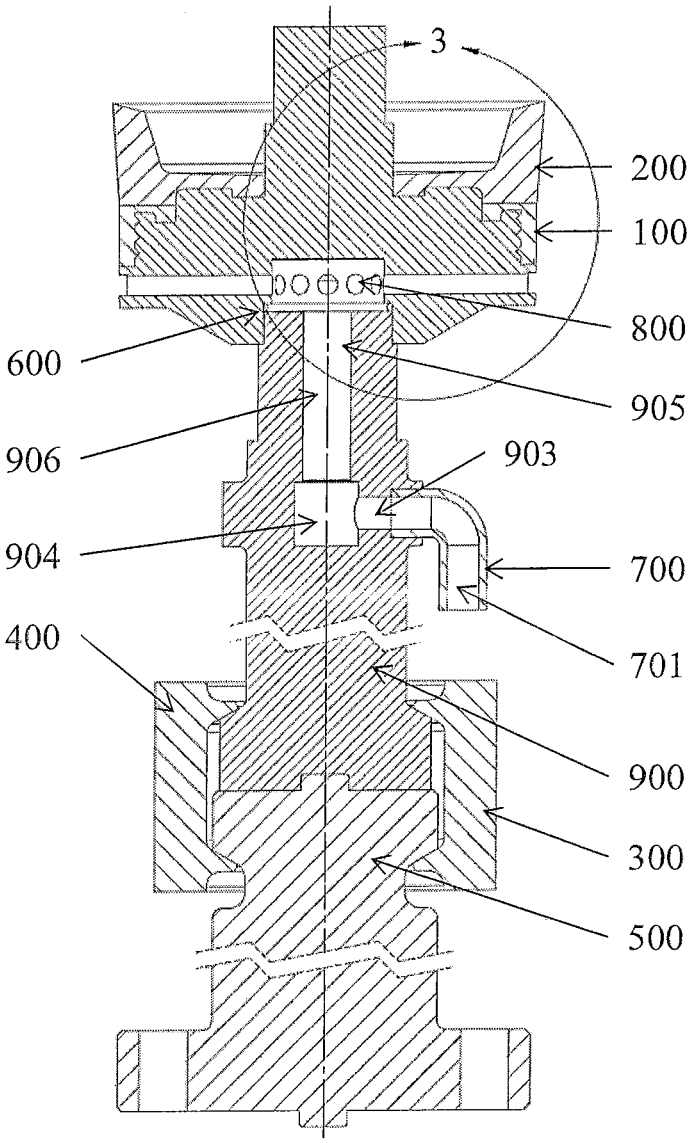
FIG. 2 is a cross-sectional view of one embodiment of the present invention.
Figure 3:
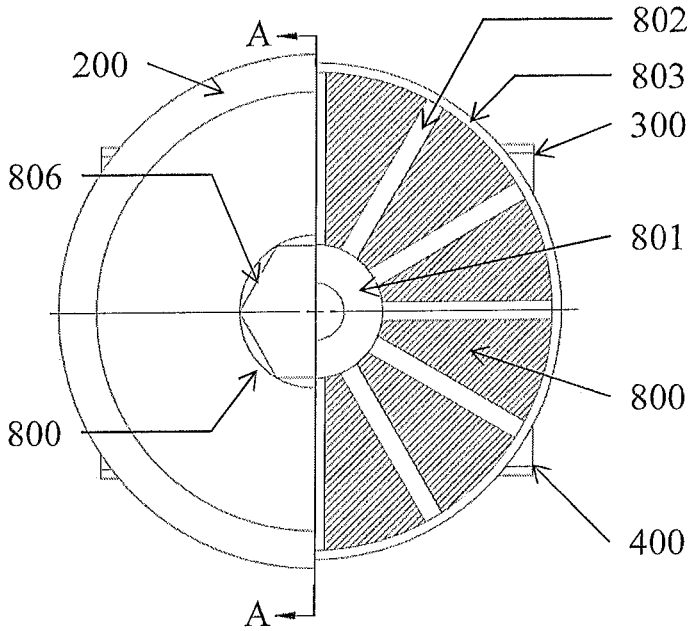
FIG. 3 is a partial front cross-sectional view of the embodiment in FIG. 1.

FIGS. 1-3 refer to some embodiments of the present invention. Accordingly, the piston comprises a piston rod 900 and a piston top. The piston rod has a reciprocal end connected with a power source, and a thread head 902 at its second end.

A coolant passage 905 is provided to the piston rod. Preferably, said coolant passage 905 has a longitudinal axis approximately parallel to the piston rod's longitudinal axis 906. More preferably, the two axes coincide.

The coolant passage has a first end and a second end. The first end has an opening on the top of the thread head 902, while the second end is connected to an elbow 904 that has the same or slightly larger diameter as to those of the coolant passage. The elbow stabilizes and streamlizes coolant flows transiting from the inlet nozzle 903, which is further connected to a pipe inlet elbow 700 and an elbow passage 701.

The elbow passage 701 is further connected to an inlet passage which in term connects to a pressure source for the coolants. It allows a continuous stream of the coolants to the piston even while said piston is moving back-and-forth. The diameter, the length, the arrangement and materials of the coolant passage 905, the elbow 904 and the elbow passage 701 are deemed readily apparent and obvious to those skilled in the art.

The coolants may be water, oil, or other suitable fluid such as water-based coolants.

The piston top consists of a piston hub 800 and a seal 100&200. The seal may be made of one material that provides flexibility and elasticity with strength, as well as heat and erosion resistances. Alternatively, the seal may comprise a hard segment 100 and a soft segment 200. The hard segment 100 is featured with relative hardness as to the soft segment 200, and provides a base and support thereto. For example, the hard segment 100 may be made of high-temperature and water friendly, hydrolysis-resistant ether-based hard polyurethane, while the soft segment 200 may be made of strong ester-based polyurethane, which has the best resistance to abrasion, wear and oil.

The seal 100&200 may be mounted to the piston hub 800 by conventional methods known to those skilled in the art. For example, it may be bonded to the piston hub 800. Preferably, the seal 100&200 is detachably mounted to the piston hub 800, so that it may be removed whenever necessary.

Referring to FIGS. 1-4, the piston hub 800 includes a hex head portion 806 and a flange portion. The hex head portion 806 projects from the flange portion along the longitudinal axis of the piston hub away from the piston rod. Accordingly, a passing-through hole is provided to the center of the seal. The shape and diameter of said passing-through hole fit the peripheral shape and diameter of corresponding part of the hex head portion 806 passing through said hole. Preferably, the hex head portion 806 is shaped as a hexahedron at its extended end away from the piston rod. This embodiment of the piston hub has consolidated traditional hub, its fastening nut, and the front portion of traditional piston rod. It significantly reduces field work required to install and replace pistons. Most of all, this embodiment of the piston hub design have enough volume to include the cavity for placing the heat exchanger therein, without compromising the strength thereof.

The flange portion has a lateral surface facing a wall of the cylinder or the liner, a front surface facing working space of the cylinder or the liner, and a rear surface facing the piston rod.

The lateral surface has a first projection 811 and a second projection 812. Both projections extend round the entire circumference of the lateral surface, and have their diametral clearances with the wall of the cylinder or the liner. Depending on the size of the piston, the minimum clearance between the projections and liner is in the range of 0.001-0.3 inch, preferably 0.005-0.2 inch.

Accordingly, the second projection 812 extends at a manner that its first side 813 close to the first projection extends at a greater length than its second side 814 close to the piston rod. In other words, the first side of the second projection 813 has a greater diameter than that of the second side 814. Therefore, an annual outlet nozzle 804 is formed between the wall of the cylinder or the liner and the lateral surface between the first end and the second end of the second projection.

Said nozzle 804 is featured by an angle (angle $\alpha$) defined by the wall of the cylinder or the liner and the lateral surface between the first side and the second side of the second projection. The angle of the nozzle can be from 0° degree up to 60°, and preferably in the range of 5°-30°. The nozzle boosts the coolants' spraying speeds to flush off wear debris and heat on the liner wall with near 0 degree more efficient shearing. The nozzle also creates a slope at the lateral surface which may prevent scratches on the liner due to any misalignment, which is one of the major causes of failures to the liners and the pistons.

Accordingly, an annulus, also termed as coolant reservoir 803, is provided between the first and second projections. The clearance between the annulus and the liner is larger than those of the first projection and the first side of the second projection.

The rear surface has a reciprocal recess coupling the threaded head 902 of the piston rod 900 wherein the threaded head may thread into the piston hub 800.

The piston hub is further provided with a centralized manifold 801 which has a connecting opening to the reciprocal recess. Preferably, said manifold 801 is arranged along the longitudinal axes of the piston hub 800. Even more preferably, the longitudinal axis of the manifold 801 coincides with the longitudinal axes thereof.

Accordingly, when the piston rod 900 is fully threaded into the recess, the manifold 801 will be communicating with the coolant passage 905 through the connecting opening. Preferably, an O-ring 600 or similar structure is provide to the connecting opening, wherein said O-ring 600 seals the communication between the coolant passage 905 and the centralized manifold 801 wherein it prevents the coolants from leaking.

The centralized manifold 801 could be any configuration that known to those skilled in the art. For example, it could be a sphere or a cylindrical column. It has a maximum diameter, which is measured perpendicularly to the longitudinal axis of the piston hub, greater than that of the coolant passage 905.

Figure 4:
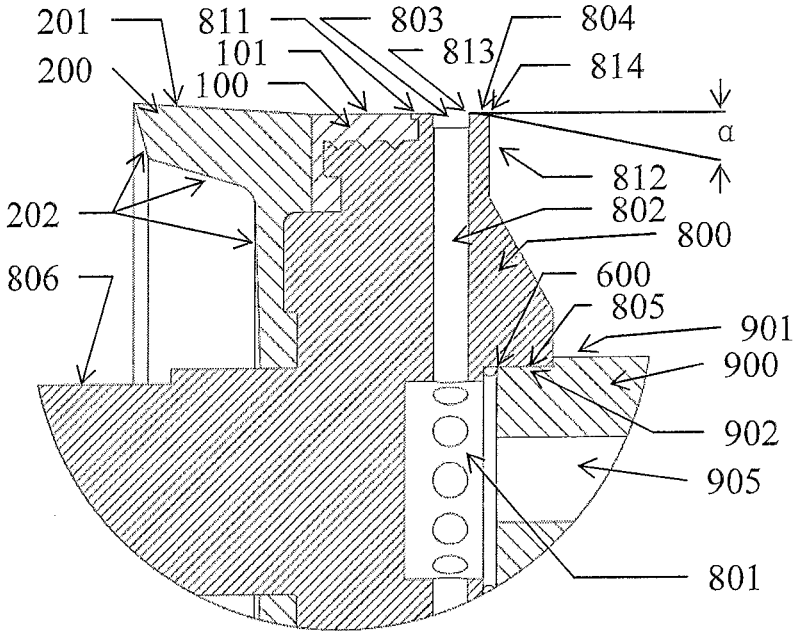
FIG. 4 is an enlarged cross-sectional view of area 3 of FIG. 2.
Figure 5:
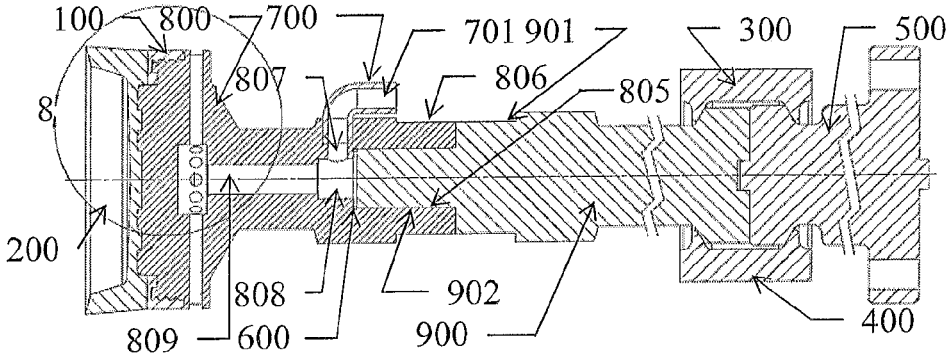
FIG. 5 is a side cross-sectional view of one embodiment of the present invention.
Figure 6:
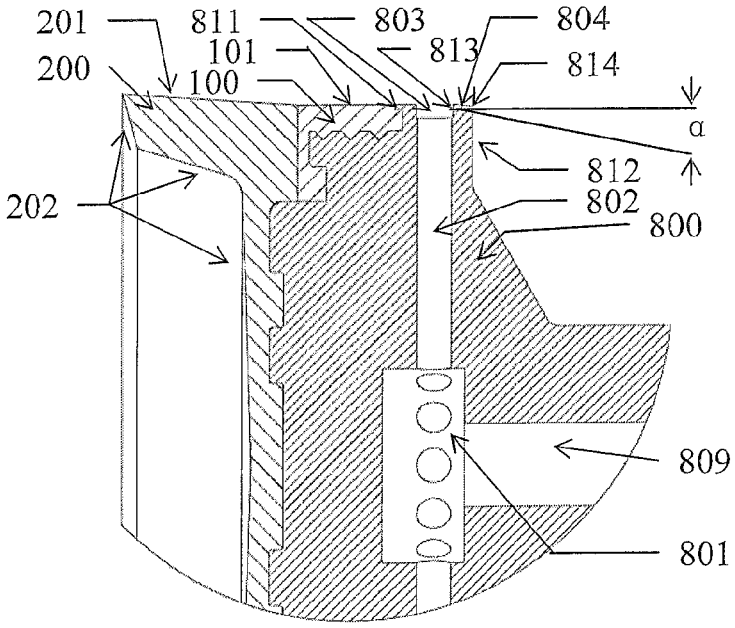
FIG. 6 is an enlarged cross-sectional view of area 8 of FIG. 5.
Figure 7:
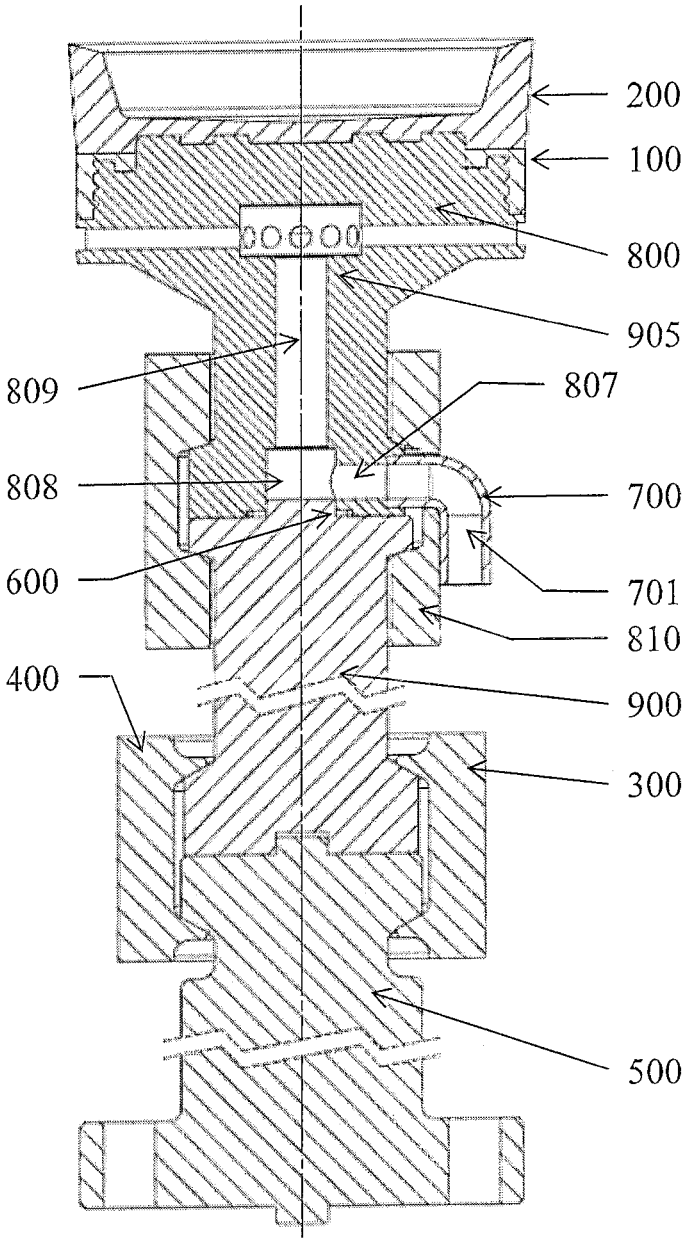
FIG. 7 is a side cross-sectional view of one embodiment of the present invention.

A plurality of holes is distributed to the centralized manifold's surface. Said holes are preferably provided in a manner that all of them locate at a plane perpendicular to the longitudinal axis of the piston hub. Alternatively, said holes may locate at multiply planes that perpendicular to the longitudinal axis of the piston hub. Each of the holes is connected with a channel 802 passing through the piston hub, extending radially toward the coolant reservoir 803, and connecting thereto. FIGS. 2-4 refer to the manifold wherein all the holes are placed at one plane.

Accordingly, at least two holes and at least two channels 802 are provided in the piston hub and on an internal surface to the centralized manifold. Preferably, the holes and the channels 802 are evenly distributed on the plane or within the piston hub 800, which will lead to evenly distributed coolant flows.

The channels 802 and the coolant manifold 801 may be made of any material known to those skilled in the art. For example, they could be made of materials the same as to those of the piston hub 800. Preferably, they are made of stainless steels which reduce potential rust.

Accordingly, the coolants are forced into the inlet from the pressure source. Said coolants then pass through the coolant passage 905 and into the coolant manifold 801. Next, said coolants flow into the channels 802 and squirt out from the outlet nozzle 804, wherein the heat and the wear debris are carried away.

The manifold 801 provides an effective and uniformed distribution of the coolants to the lateral surface of the piston hub 800. At the same time, its greater diameter provides the enlarged internal surface for providing a greater number of the holes at one plane, or multiple planes without further compromising the strength of the piston including its hub and rod. The increased number of the holes and the channels means greater efficiency in exchanging heat generated and accumulated within the piston hub. The greater number of the channels also leads to more uniformly distributed coolants in the coolant reservoir. More importantly, the enlarged internal surface can also accommodate a number of the holes and the channels having larger diameters drilled through radially without crossing through each other. The diameter of the channels can be as big as 0.5 inch. This feature overcomes commonly-reported field issues with prior arts having one radial or one diametral simple small passage. The small passage often suffers blockage by debris or rust from re-circulated liner washing water.

FIGS. 4-7 show yet some other embodiments of the present invention. Wherein the piston hub does not have the hex head portion and the seal does not have the passing through hole to its center.

Accordingly, the coolant passage 809, the elbow 808 and the inlet nozzle 807 are provided to the piston hub 800 and connected to the centralized manifold 801 therein. The piston rod 900 is threaded onto the piston hub 800, wherein may be enforced by a piston clamp 801.

A plurality of coupling grooves and coupling projections are provided to the front surface and the lateral surface of the piston hub, wherein counterparts corresponding to said grooves and projections are provided to a portion of the seal that interacts with the piston hub. Said grooves and projections, as well as their counterparts, are mechanisms to securing the seal to the piston hub. Similar designs may be applied to other embodiments of the present invention. The exact number, shape, and arrangement of them are readily apparent to those skilled in the art.

With respect to the above description, it is to be realized that the optimum dimension, materials, shapes, forms, operations and/or functions of the present invention, whether being specifically disclosed herein or not, are deemed readily apparent and obvious to those skilled in the art, and all equivalent relationships to those illustrated in the drawings and described herein are intended to be encompassed by the present invention.

We claim:

1. A piston, comprises:

a coolant passage and an elbow, wherein both are provided within said piston;

a piston hub, wherein said piston hub has at least one projection extending from its lateral surface, an annulus, a recess to which a piston rod is counted and threaded, and an outlet nozzle; and, a coolant centralized manifold within the piston hub and is able to communicate with the coolant passage, wherein said manifold has a connecting opening to the recess and is provided with a plurality of holes, each hole is connected to a channel radially extending within the piston and connecting to the annulus.

2. The piston of claim 1, further comprises a seal, wherein said seal includes a soft segment and a hard segment.

3. The coolant manifold of claim 1, wherein said manifold has a greater maximum diameter than that of the coolant passage.

4. The piston hub of claim 1, further comprises a hex head portion and a flange portion, wherein the hex head is a hexahedron.

5. The outlet nozzle of claim 1, wherein its angle is between 0 to 60 degrees.

6. The outlet nozzle of claim 1, wherein its angle is between 5 to 30 degrees.

7. The piston hub of claim 1, wherein the holes are evenly distributed on at least one plane perpendicular to a longitudinal axis of the piston hub.

8. The elbow of claim 1, wherein said elbow has a maximum diameter greater than that of the coolant passage.

9. The piston of claim 1, wherein the elbow and the coolant passage are provided to a piston rod.

10. The piston of claim 1, wherein the elbow and the coolant passage are provided to the piston hub.

11. A piston, comprises:

a coolant passage and an elbow, wherein both are provided within said piston;

a piston hub, wherein said piston hub has at least one projection extending from its lateral surface, an annulus, a recess and an outlet nozzle, wherein its angle is between 5 to 30 degrees; and, a coolant centralized manifold within the piston hub and is able to communicate with the coolant passage, wherein said manifold is provided with a plurality of holes, each hole is connected to a channel radially extending within the piston and connecting to the annulus.

12. The piston of claim 11, further comprises a seal, wherein said seal includes a soft segment and a hard segment.

13. The piston rod of claim 11, further comprises a coolant elbow passage that connects and communicate to the elbow.

14. The coolant manifold of claim 11, wherein said manifold has a greater maximum diameter than that of the coolant passage.

15. The piston hub of claim 11, further comprises a hex head portion and a flange portion, wherein the hex head portion is a hexahedron.

16. The piston hub of claim 11, wherein the holes are evenly distributed on at least one plane perpendicular to a longitudinal axis of the piston hub.

17. The elbow of claim 11, wherein said elbow has a maximum diameter greater than that of the coolant passage.

18. The piston of claim 11, wherein the elbow and the coolant passage are provided to a piston rod.

19. The piston of claim 11, wherein the elbow and the coolant passage are provided to the piston hub.

* * * * *